United States Patent [19]

Sakurai

[11] Patent Number: 4,980,703

[45] Date of Patent: Dec. 25, 1990

[54] PRINT HEAD FOR INK-JET PRINTING APPARATUS

[75] Inventor: Kikukazu Sakurai, Tokyo, Japan

[73] Assignee: NEC Corporation, Japan

[21] Appl. No.: 443,792

[22] Filed: Nov. 22, 1989

Related U.S. Application Data

[63] Continuation of Ser. No. 188,225, Apr. 29, 1988, abandoned.

[30] Foreign Application Priority Data

Apr. 30, 1987 [JP] Japan ..... 62-10837

[51] Int. Cl.[5] ..... B41J 2/05; B41J 2/135

[52] U.S. Cl. ..... 346/140 R

[58] Field of Search ..... 346/140

[56] References Cited

U.S. PATENT DOCUMENTS

| | | | |
|---|---|---|---|
| 4,312,009 | 1/1982 | Lange | 346/140 |
| 4,334,234 | 6/1982 | Shirato | 346/140 |
| 4,368,476 | 1/1983 | Uehara | 346/140 |
| 4,490,728 | 12/1984 | Vaught | 346/140 X |
| 4,580,148 | 4/1986 | Domoto | 346/140 |
| 4,587,534 | 5/1986 | Saito | 346/140 |
| 4,725,862 | 2/1988 | Matsuzaki | 346/140 |
| 4,751,533 | 6/1988 | Saito | 346/140 |

OTHER PUBLICATIONS

Hewlett-Packard Journal, vol. 36, No. 5, May 1985, pp. 21-26 and 33-37.

*Primary Examiner*—Joseph W. Hartary

*Attorney, Agent, or Firm*—Laff, Whitesel, Conte & Saret

[57] ABSTRACT

A print head for an ink-jet printing apparatus has a plurality of heater elements arranged in a first direction on one surface of a substrate. A nozzle plate is positioned substantially parallel to and displaced from the surface of the substrate with a predetermined interval therebetween in order to form an ink chamber for retaining recording ink. A slit nozzle extends in the first direction on the nozzle plate and at a position which is opposite the heater elements. Barrier walls are formed on the surface of the substrate and between a plurality of the heater elements, respectively, the barrier walls extending in a second direction which is substantially perpendicular to the first direction. The heater elements generates vapor bubbles in the recording ink to produce energy for ejecting ink droplets from the slit nozzle and in the direction perpendicular to the surface of the substrate.

5 Claims, 4 Drawing Sheets

PRINT HEAD FOR INK-JET PRINTING APPARATUS

This application is a continuation, of application Ser. No. 07/188,255, filed 4/29/88 now abandoned.

BACKGROUND OF THE INVENTION

The present invention relates to a print head for an ink-jet printing apparatus which ejects ink droplets onto a sheet of paper for recording.

A conventional print head is disclosed in the Hewlett-Packard Journal, May issue, 1985, Vol. 36, No. 5, particularly on pp. 21–26 and pp. 33–37. In the print head, a heater is provided in an ink chamber, and the vapor pressure produced by the heater enables ink droplets to be ejected toward a sheet of paper. The conventional print head comprises a plurality of heater elements formed on a substrate and a nozzle plate covering the substrate. A plurality of barrier walls are provided on the nozzle plate in order to provide an ink chamber for each of the heater elements. The nozzle plate is provided with nozzle holes at positions between the barrier walls in alternate arrangement to form a multi-nozzle print head.

In the conventional print head, it is extremely difficult to precisely align the barrier walls and the nozzle holes of the nozzle plate with respect to the heater elements formed on the substrate. As a result, the contents of the ink chambers are not constant to deteriorate the uniformity of ink-injection characteristics of the ink chambers.

SUMMARY OF THE INVENTION

An object of the present invention is, therefore, to provide a print head for an ink-jet printing apparatus and has uniform ink droplet injection characteristics of every ink chamber.

Another object of the present invention is to provide a print head for an ink-jet printing apparatus which can form plural ink chambers precisely in alignment with corresponding heater elements.

Still another object of the present invention is to provide a print head for an ink-jet printing apparatus which can precisely position nozzle holes of the nozzle plate with respect to corresponding heater elements formed on a substrate.

According to one aspect of the present invention, there is provided a print head for an ink-jet printing apparatus, which comprises a slit nozzle plate having a slit nozzle which extends over a plurality of ink chambers for forming and ejecting ink droplets. Such a slit nozzle plate eliminates the necessity of provision of a nozzle hole for each of heater elements even when the heater elements are arranged at a high density. Therefore, there is no need to align the nozzle holes with the heater elements. Moreover, barrier walls are formed on a substrate on which the heater elements are provided. Therefore, the barrier walls are precisely located with respect to the heater elements. The presence of the barrier walls can effectively converge the pressure waves produced by vapor bubbles onto the slit nozzle section. The presence of the ink chamber walls can also reduce the interference caused when the adjacent heater elements are simultaneously driven.

BRIEF DESCRIPTION OF THE DRAWINGS

In the drawings, the same reference numerals denote the same structural elements.

DESCRIPTION OF THE PREFERRED EMBODIMENT

Figure 1A:
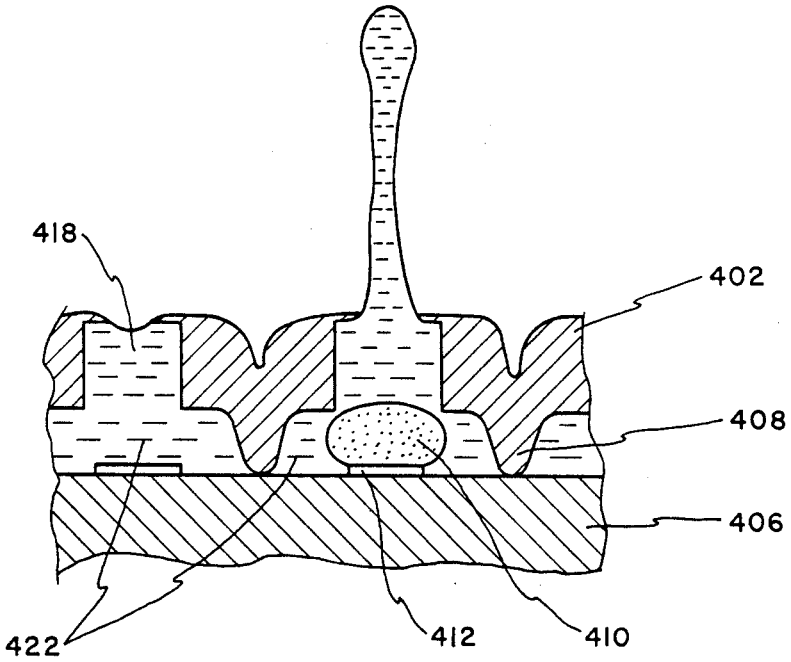
FIG. 1a PRIOR ART
FIGS. 1*a* and 1*b* are a plan view and a cross sectional view of a conventional print head for an ink-jet printing apparatus.
Figure 1B:
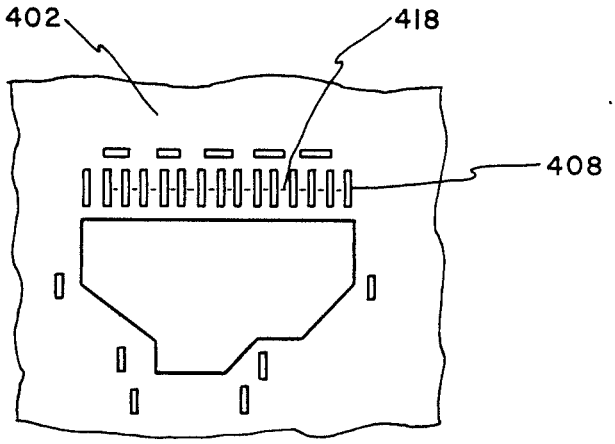
FIG. 1b PRIOR ART

In order to facilitate the understanding of the present invention, the above-mentioned conventional print head will first be described referring to FIGS. 1*a* and 1*b*. The print head comprises a nozzle plate 402, a substrate 406 and heater elements 412. The nozzle plate 402 are provided with a plurality of barrier walls 408 at its inner surface to provide an ink chamber 422 for each heater element 412. FIG. 1*b* shows the shape of the nozzle plate 402. As shown in FIGS. 1*a* and 1*b*, a multi-nozzle head in realized by alternate arrangement of nozzle holes 418 and the barrier walls 408 on the nozzle plate 402.

In the above-described conventional print head, it is difficult to precisely align the positions of the nozzle holes 418 and the barrier walls 408 with respect to the heater elements 412 since the nozzle holes 418 are separately formed and the barrier walls 408 are formed on the nozzle plate 402.

Figure 2:
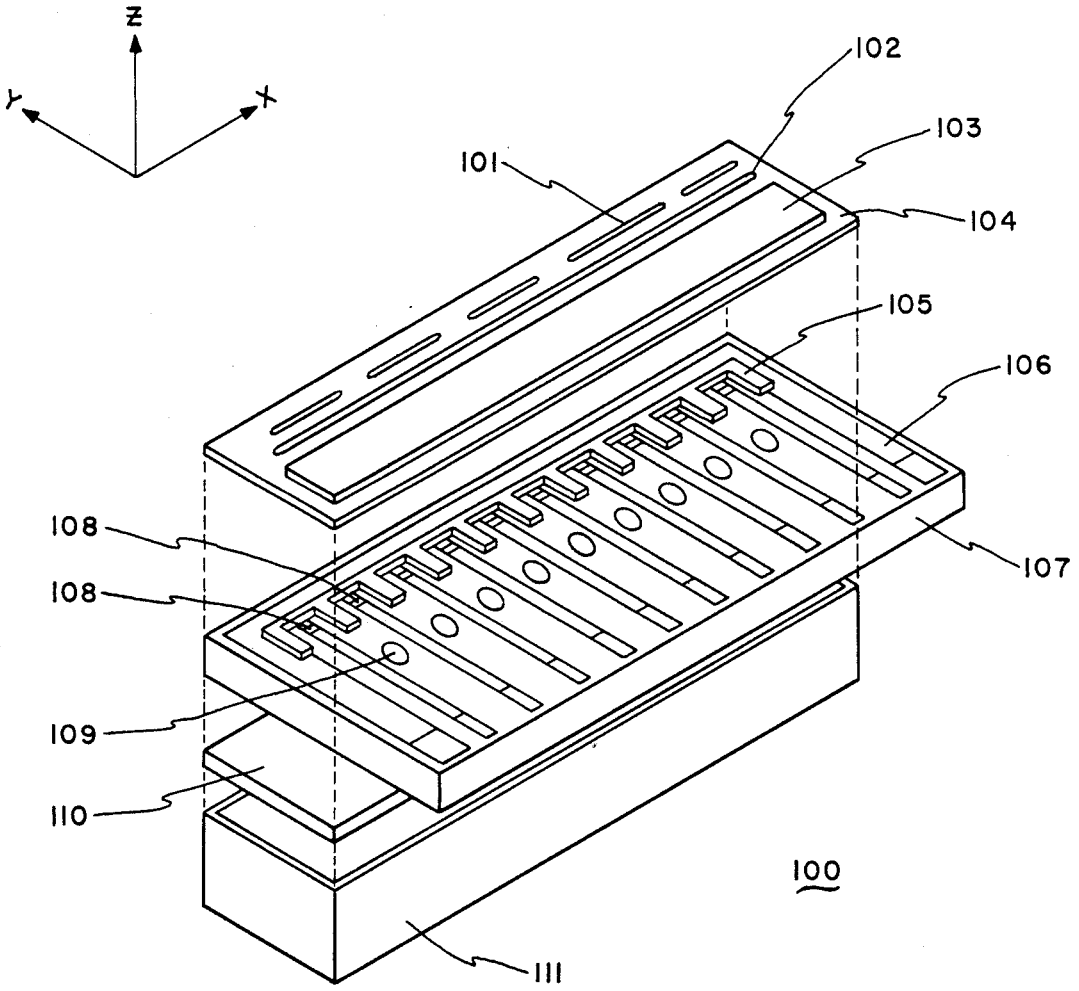
FIG. 2 is a perspective view showing an embodiment of the present invention.

An embodiment of the present invention will now be described hereinafter. Referring to FIG. 2, an embodiment of the present invention includes a nozzle plate 104, a substrate 107 and an ink tank 111 to form a slit nozzle ink-jet head 100. The nozzle plate 104 is provided with a slit nozzle 102 for ejecting ink droplets, a reserver reservoir 103 for reducing ink supply resistance, and supplementary holes 101 for facilitating smooth ink supply.

The substrate 107 is provided with heater elements 108 in the form of array for producing vapor bubbles, barrier walls 105 which prevent pressure generated by the vapor bubbles from dispersing, and an electrode array 106. The ink is supplied from the ink tank 111 through ink supply pathes 109 via a filter 110. The nozzle plate 104 is located on the substrate 107 and edge portions of the nozzle plate 104 are fixed to the substrate 107 by adhesive resin 303 (FIG. 4) to form sealed ink chambers.

Figure 3A:
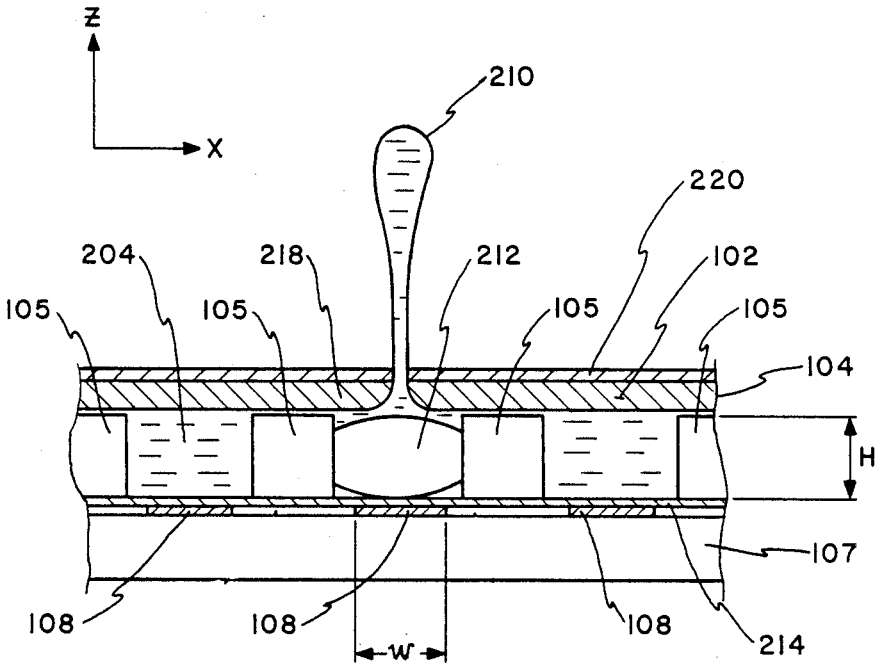
FIGS. 3*a* and 3*b* are cross sectional views showing the embodiment of the invention of FIG. 2.
Figure 3B:
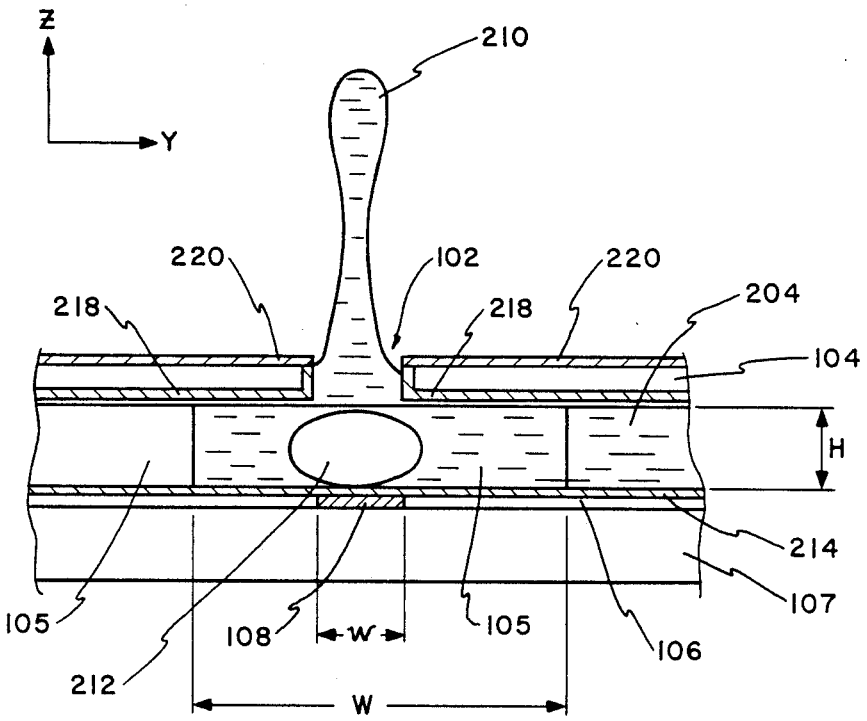

FIG. 3*a* shows the ink-jet head 100 in the section taken along the longitudinal axis of the slit nozzle 102 (in X-Z plane in FIG. 2). FIG. 3*b* shows the same in section taken along the vertical direction to the longitudinal axis of the slit nozzle 102 (in Y-Z plane in FIG. 2).

As shown in FIGS. 3*a* and 3*b*, the vapor bubble 212 is produced on a protecting layer 214 formed on the heater element 108, which is in contact with the electrode 106. The pressure waves produced by the vapor bubble 212 are uniformly and radiately transmitted in ink 204. The interval length (=the height of the barrier walls 105) H between the slit nozzle plate 104 and the protecting layer 214 is determined to be equivalent to or less than a pitch length (about 125 $\mu$m) of the heater elements. The barrier walls 105 are formed on the substrate 107 at the position between the heater elements 108, respectively. Therefore, the fluid resistance of the ink 204 in the direction toward the slit nozzle 102 (in the Z direction) can be reduced to a value less than the fluid resistance in the direction parallel to the protecting layer 214 (in the X direction). Therefore, the pressure waves are converged in the Z direction so as to generate and eject an ink droplet 210.

It is preferable to determine the height H of the barrier walls 105 at a value larger than the height of the vapor bubble 212. The width W of the barrier walls 105 is preferably determined by a value equal to or higher than the width w of the heater element 108. In the preferred embodiment, the ink-jet head 100 has the height H of the barrier wall 105 of 32 to 38 μm (preferably 35 μm) and the width W therefore of 50 to 200 μm (preferably 100 μm) while the width w of the heater element 108 is 70 μm. The nozzle plate 104 is provided with slit nozzle 102 having the width of 20 to 100 μm which is opposed to the array of the heater elements 108. The width of the slit nozzle 102 is, therefore, 0.16 0.80 times the pitch length (125 μm) of the heater elements 108. The nozzle plate 104 is made of metal, which is formed by electroplating, photoetching or plate work. The nozzle plate 104 may be formed by photoetching to a glass plate or by laser-beam processing.

Upon rejection, it is apparent that the slit nozzle has a width of about 0.16 to 0.80 times the pitch length of the heater element. More particularly, the pitch length of the heater element is given at about 125 μm. The slit width is given at about 20 to 100 μm. Therefore, it is simple arithmetic to show that the nozzle width to pitch length is a range of 0.16 (20/125) to 0.80 (100/125).

The inner surface and the sectional surface of the nozzle plate 104 are applied with a hydrophilic agent 218 to improve wettability thereof. The outer surface of the nozzle plate 104 is applied with a water repellent agent 220 in order to reduce the wettability conversely. These arrangement facilitates the supply of ink 204 to the slit nozzle 102 at a higher speed and the generation of ink droplets 210 more stably. Alternatively, the nozzle plate 104 itself may be made of a hydrophilic material and a outer surface thereof is applied with a water repellent agent. The heater elements 108 may be formed on a substrate 107 by vapor-deposition or spattering.

The heater elements 108 may be made from silicides, carbides, borides or nitrides of Ti, Mo, W, V, Nb, Zr, Ta, or nickel chrome. The substrate 107 may be made of ceramics or glass. The protecting layer 214 is effective in isolating the heater elements 108 and the electrodes 106 from the ink 204 so as to prevent precipitation of the ink 204 due to its ionization. Further, the protecting layer 214 prevents corrosion of the heater elements 108 and the electrodes 106. In order to generate stable vapor bubbles 212, the protecting layer 214 on the heater elements 108 may be imparted with water repellent characteristic or may be applied with a film with excellent water repellent or heat resistant characteristics.

The protecting layer 214 located other than above the heater elements 108 are favorably provided with hydrophilic characteristics. The protecting layer 214 is made without pin holes so as to generate stable vapor bubbles 212. The barrier walls 105 are made of a resin with a high heat- and chemical-resistance. In this embodiment, it is made of polyimide resin. The recording ink 204 may be either water-based or oil-based so far as it has a viscosity of 2 to 10 cP (preferably 5 cP).

Figure 4:
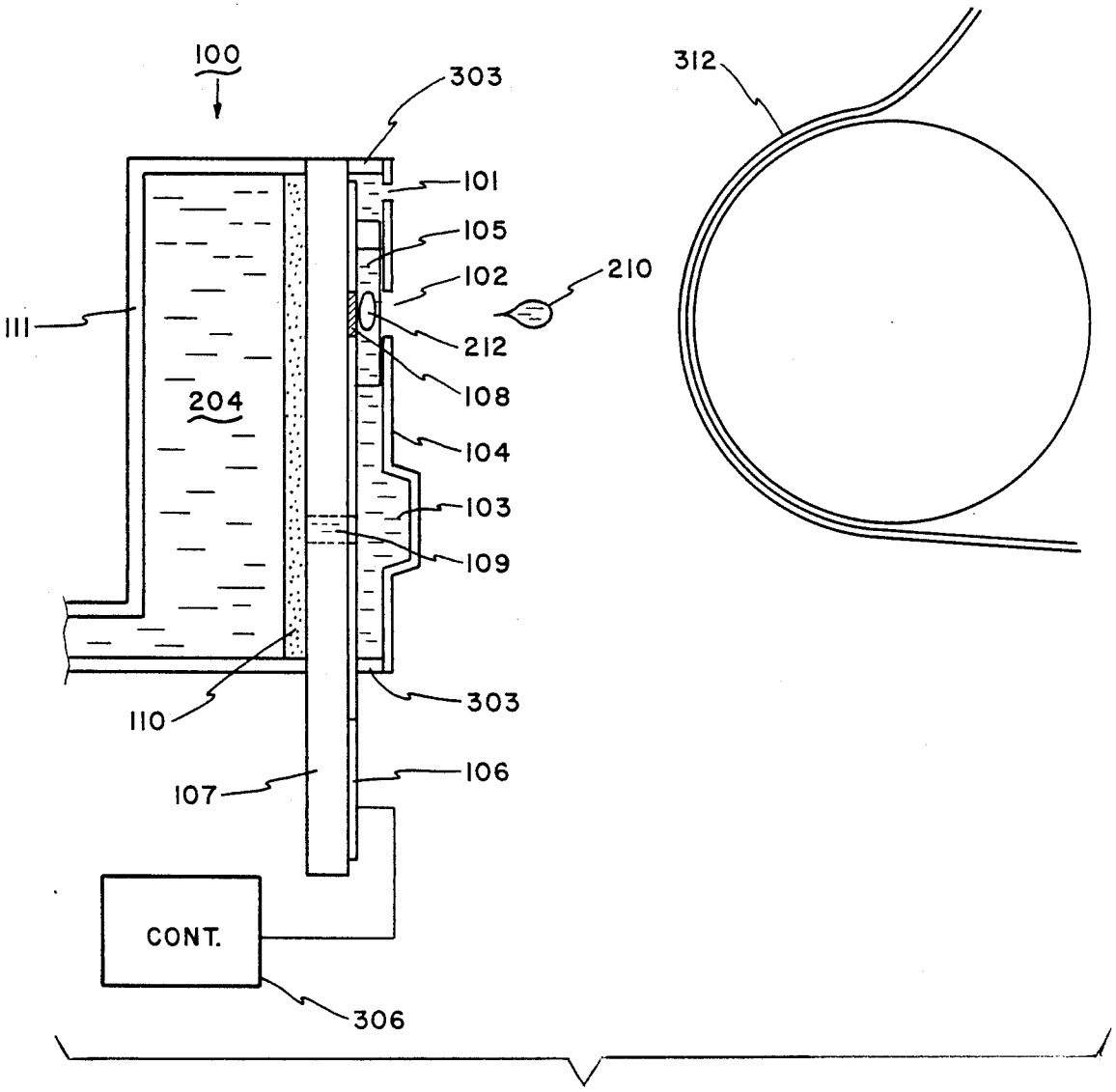
FIG. 4 is a cross sectional view showing an ink-jet printer employing the embodiment of the invention of FIG. 2.

FIG. 4 shows a recording apparatus using the embodiment of the invention. A controller 306 applies voltage pulses to the electrodes 106 in correspondence to recording signals. In this embodiment, the applied voltage pulses were at voltage of 24 Volt, and of the pulse width of 2 μsec. The ink 204 is supplied from the ink tank 111 through the ink supply path 109 by surface tension. The ink supply path 109 has a function to constantly supply the ink 204 to the every ink chambers. As the velocity of the generated ink droplets 210 is about 5 m/sec., even if the interval between a recording sheet 312 and the head 100 is relatively large, the positional deviation of the recording dots can be reduced. In this embodiment, when the interval between the recording medium 312 and the ink-jet head 100 is set at about 1 mm, the density of recording dots 8 dots/mm can be realized.

As described in detail in the foregoing, the ink-jet head of the present invention includes the nozzle plate provided with the slit nozzle, and the barrier walls formed on the substrate. Accordingly, it can eliminate the precise adjustment for positioning the nozzle holes and the barrier walls with respect to each heater elements so as to prevent variations of the contents of the ink chambers which might otherwise cause uneven ejection of ink droplets. The present invention simplifies the structure of the nozzle to realize and ink-jet head of plane scanning type which integrates the ink chambers each of which generates ink droplets uniformly at a higher density.

What is claimed is:

1. A print head for an ink-jet printing apparatus, said print head comprising:

a plurality of heater elements arranged in a first direction on a substrate for generating vapor bubbles in recording ink supplied onto said substrate, said heater elements being separated and apart from each other in said first direction by a pitch length and said vapor bubbles producing energy in said recording ink necessary for ejecting said ink;

barrier walls formed on said substrate between a plurality of said heater elements, respectively, said barrier walls extending in a second direction which is substantially perpendicular to said first direction;

a nozzle plate parallel to and spaced from said substrate to form ink chambers together with said substrate for retaining said recording ink; and a slit nozzle formed on said nozzle plate to extend in said first direction at a position opposing an array of said heater elements, said slit nozzle having a width of about 0.16 to 0.80 times said pitch length of said heater elements.

2. A print head as claimed in claim 1, wherein said nozzle plate is covered by a hydrophilic layer formed on inner surface of said ink chamber and a water repellent layer formed on outer surface of said ink chamber.

3. A print head as claimed in claim 1, wherein a hight of said barrier walls is either equal to or shorter than a pitch between said heater elements.

4. A print head as claimed in claim 1, wherein a width of said barrier walls is larger than a width of said heater elements.

5. A print head as claimed in claim 1, wherein said barrier walls are made of polyimide resin.

* * * * *